US005765079A

United States Patent [19]

Yoshiki et al.

[11] Patent Number: 5,765,079

[45] Date of Patent: Jun. 9, 1998

[54] TONER BOTTLE

[75] Inventors: Shigeru Yoshiki, Kawasaki; Noboru Kusunose; Kenzo Tatsumi, both of Yokohama; Hideo Yoshizawa, Urawa, all of Japan

[73] Assignee: Ricoh Company, Ltd., Tokyo, Japan

[21] Appl. No.: 686,070

[22] Filed: Jul. 24, 1996

[30] Foreign Application Priority Data

Jul. 24, 1995 [JP] Japan ..... 7-187505
May 1, 1996 [JP] Japan ..... 8-110863

[51] Int. Cl.[6] ..... G03G 15/08

[52] U.S. Cl. ..... 399/258; 222/167; 222/DIG. 1; 399/120; 399/262

[58] Field of Search ..... 399/120, 258, 399/260, 262; 141/90; 222/DIG. 1, 167

[56] References Cited

U.S. PATENT DOCUMENTS

| | | | |
|---|---|---|---|
| 3,853,246 | 12/1974 | Dubois | 222/DIG. 1 |
| 5,416,568 | 5/1995 | Yoshiki et al. . | |
| 5,455,662 | 10/1995 | Ichikawa et al. . | |
| 5,531,253 | 7/1996 | Nishiyama et al. | 141/90 |
| 5,557,382 | 9/1996 | Tatsumi et al. | 399/262 |
| 5,576,816 | 11/1996 | Staudt et al. | 399/262 |
| 5,598,254 | 1/1997 | Ikesue et al. | 399/262 |

FOREIGN PATENT DOCUMENTS

| | | |
|---|---|---|
| 59 188678 | 10/1984 | Japan . |
| 60 146265 | 8/1985 | Japan . |
| 7 20705 | 1/1995 | Japan . |
| 7 43999 | 2/1995 | Japan . |
| 7 140774 | 6/1995 | Japan . |
| 8-179612 | 7/1996 | Japan . |

*Primary Examiner*—Matthew S. Smith
*Attorney, Agent, or Firm*—Oblon, Spivak, McClelland, Maier & Neustadt, P.C.

[57] ABSTRACT

A toner bottle has a bottle body (1) containing toner and a cap (5) closing an opening portion (3) formed in the bottle body (1), and toner is supplied through the opening portion (3). A plateshaped toner scraping member (20) extending into the opening portion (3) and having elasticity is provided on the back surface of the cap (5) in the diameter direction of the cap (5). Also, the outer end of the toner scraping member (20) is positioned inside of the bottle body (1) beyond the opening portion (3) even when the cap (5) is in its cap-opened position. If the toner bottle is constructed in this way, the toner on the opening portion (3) will be scraped by the toner scraping member (20) and toner condensation can be reliably prevented at the opening portion (3) when toner is supplied from the bottle body (1) by rotation of the toner bottle.

27 Claims, 6 Drawing Sheets

FIG. 9
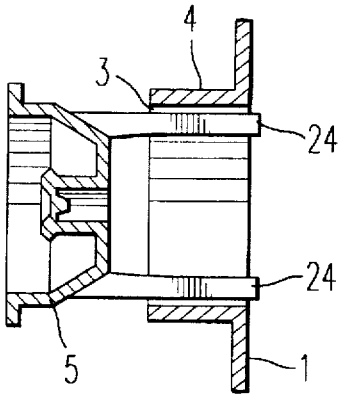
FIG. 10A
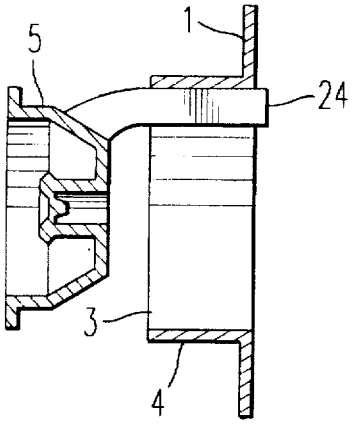
FIG. 10B
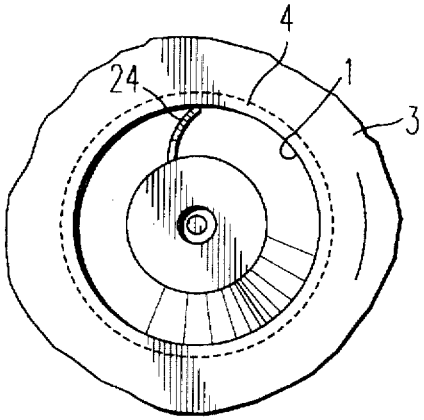
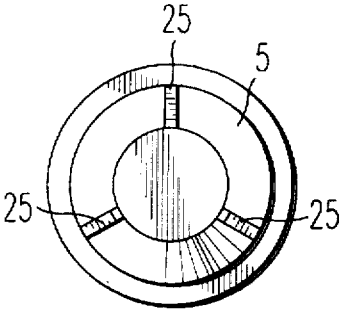
FIG. 11A
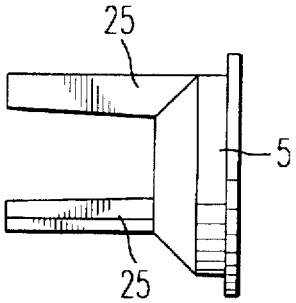
FIG. 11B

TONER BOTTLE

BACKGROUND OF THE INVENTION

1. Field of the Invention

The present invention relates to a toner bottle containing toner which is supplied to the developing unit of image forming apparatuses such as printers) copying machines, and facsimiles.

2. Description of the Prior Art

Copying machines, facsimiles, and printers making use of electrophotography are widely used. Electrophotography is the process of forming an electrostatic latent image on a thin layer of photoconductive photosensitive material and transferring an image formed with colored particles (called toner) held on the charged latent image onto paper. In an image forming apparatus making use of the electrophotography, if toner is consumed and run out from the developing section, toner will then be supplied to the developing section and will continue to be used. An example of a mechanism for supplying toner is described, for example, in Japan Laid-Open Patent Publication Nos. SHO 59-188678 and SHO 60-146265. As described in these publications, a toner supply unit is known where a toner battle containing toner and having a discharge port at its front surface is rotated and the rotation causes toner to be supplied from the discharge port to the developing section of an image forming apparatus.

In the toner supply unit, the toner bottle is installed to the image forming apparatus as follows. That is, when toner is supplied, a bottle mounting holder, provided horizontally on the main body of the image forming apparatus, is rotated downward about its one end so that it is disposed vertically. If the toner bottle is used up and becomes empty in the vertical position, it is removed from the bottle mounting holder. Then, a new toner bottle filled up with toner is attached to the aforementioned mounting holder. Thereafter, the bottle mounting holder is rotated to a horizontal operative position and the setup is completed. Now, the operation of attaching a new toner bottle to the bottle mounting holder held in the vertical position will be described. First, with the opening portion of a new toner bottle placed upright, a cap is removed from the opening portion, and in order to prevent the toner which is the content of the bottle from spilling, the bottle is attached to the aforementioned mounting holder while the opening portion remains upright.

However, in a method where the bottle mounting holder is caused to rotate between a horizontal position and a vertical position in the aforementioned way, there is the need for making the length of the bottle mounting holder shorter than the height of the image forming apparatus. A normal image forming apparatus is low in height, so the length of the toner bottle is also short and the holding quantity is reduced. For this reason, there is the tendency that exchange of the toner bottle must be frequently performed. Also, in a toner supply mechanism such as this, there is a design limitation the internal structure of an image forming apparatus, and the miniaturization of the apparatus is difficult.

To solve the aforementioned problems, a mechanism has been proposed which exchanges a cylindrical toner bottle while the bottle mounting holder is horizontally held (Japan Laid-Open Patent Publication No. HEI 7-20705). In this mechanism, the toner bottle with a cap on the opening portion is mounted in the mounting holder and the cap is removed automatically from the opening portion by using a collet chuck which is interrelated with the bottle mounting operation.

The mechanism for removing the cap from the toner bottle and the operation will now be described for the case where the collet chuck is used.

As shown in FIGS. 1(*a*)–1(*c*), a toner bottle 1 has a cylindrical bottle body 2 and in approximately the central portion of one end surface of the bottle body 2 there is provided a small radial opening portion 3, which is smaller than the cylindrical portion of the bottle body 2. The opening portion 3 extends outwardly from a collar 4, which in turn extends outwardly from the cylindrical bottle body 2, and a cap 5 is provided to close the opening portion 3. In the center of the cap 5, a tab portion 6 is formed. Also, in the cylindrical portion of the bottle body 2, a guide groove 7 is formed spirally to guide the toner contained in the bottle body 2 toward the opening portion 3 by rotation of the toner bottle 1.

The mechanism for removing the cap 5 from the toner bottle 1 is equipped with a chuck 10 and a chuck moving means for moving the Chuck 10 toward and away from the toner bottle 1. In the illustrated example of the mechanism for removing the cap 5, the chuck 10 is inserted into and held in a hole portion 12 of a support wall 11 formed in part of a bottle holder 8 that supports the toner bottle 1. In the inoperative state of the chuck 10 shown in FIG. 1(*a*), a clamping portion 13 which is formed in one end of the chuck 10 is urged so as to expand. FIG. 1(*b*) shows the state when the toner bottle 1 has been placed in the set position of the bottle holder 8. When the chuck 10 is moved to a position further away from the toner bottle 1 by the aforementioned chuck moving means, the large radius portion of the outer periphery of the chuck 10 is pushed by the inner peripheral surface of the aforementioned hole portion 12 and then the clamping portion 13 of the chuck 10 is narrowed and closed, whereby the tab portion 6 of the cap 5 is clamped with the closed clamping portion 13. While the chuck 10 is holding the tab portion 6 of the cap 5, it moves the cap 10 up to a position where the opening portion 3 of the toner bottle 1 can be fully opened, as shown in FIG. 1(*c*). This position is referred to as the cap-opened position of the cap 5, and during the time the toner bottle 1 is mounted in its normal position, the cap 5 is fixed and held at the cap-opened position.

By providing the cap removing mechanism in the toner supply unit of the developing section of an image forming apparatus the toner bottle 1 can be mounted in the bottle holder 8 with the opening portion 3 closed by the cap 5. When, on the other hand, the toner in toner bottle 1 is consumed and the empty toner bottle 1 is taken out from the bottle holder 8, the cap 5 can also be attached to the opening portion 3 of the empty toner bottle 1 by moving the chuck 10 in the reverse direction by the chuck moving means. Thus, in taking out the toner bottle 1 from the bottle holder 8, the opening portion 3 is closed with the cap 5, so there is no possibility that the toner on the opening portion 3 drops and stains the hands or clothes of f an operator who exchanges the empty bottle.

The toner bottle 1, constructed in the aforementioned way, has various advantages if it is used in a toner supply unit with a mechanism for removing the cap 5, but the opening portion 3 must be smaller in radius than the cylindrical portion of the bottle body 2 from the point of the mechanism.

However, if the radius of the opening portion 3 is reduced, the fluidity of the toner near the opening portion 3 will become worse and therefore the opening portion 3 will be blocked up with toner T, as shown in FIG. 2, depending upon the physical property of the toner. For this reason, only toner T having a good fluidity can be used, so there is a problem in that the kind of toner that can be used is limited. If the kind of toner is limited in this way, some of the image forming apparatuses cannot adopt a toner supply unit with a mechanism for removing the cap 5 from the point of the mechanism.

Furthermore, even toner T with a good fluidity where there is no problem at the normal room temperature will adhere to the inner peripheral surface of the opening portion 3 under high-temperature environment, as shown in FIGS. 3(*a*) and 3(*b*), and the area of the opening portion will be reduced. For this reason, the problem that the supply quantity of toner T will become reduced will exist.

SUMMARY OF THE INVENTION

Accordingly, it is an object of the present invention to provide a toner bottle which is capable of removing the limitation on the kind of toner that can be used and, furthermore, preventing a reduction in the supply quantity of toner.

To achieve this end and in accordance with one aspect of the present invention, a toner bottle comprises a bottle body for containing toner and giving a feed operation to the toner in one direction by a rotation operation, and a cap for closing an opening portion formed in the bottle body. The toner is supplied in a state in which the cap is held in a cap-opened position where the cap opens the opening portion. The toner bottle further comprises a plate-shaped toner scraping member, which extends into the opening portion of the bottle body and having elasticity. The toner scraping member is provided on the back surface of the cap in the diameter direction of the cap. The outer end of the toner scraping member is positioned inside of the bottle body beyond the opening portion even when the cap is in the cap-opened position.

With this constitution, an elastic toner scraping member is provided which goes into the opening portion of the toner bottle when it is positioned in the cap-opened portion of the cap. Therefore, the condensation of the toner at the opening portion can be prevented with reliability and the degree of freedom of the setting direction of the cap is increased.

In accordance with another aspect of the present invention, a plate-shaped toner scraping member extends into the opening portion of the bottle body. The toner scraping member is provided on the back surface of the cap in the diameter direction of the cap. The outer end of the toner scraping member is positioned inside of the bottle body beyond the opening portion even when the cap is in the cap-opened position, and an outer edge of the toner scraping member is contacted with an inner peripheral surface of the opening portion.

With this constitution, the toner scraping member slides on and along the inner peripheral surface of the opening portion. The condensation of toner at the opening portion of the toner bottle can be prevented with reliability and stagnation of the toner can be prevented. In addition, the toner that adhered to the opening portion of the toner bottle can be scraped outside and thus a sufficient supply quantity can be obtained.

In accordance with still another aspect of the present invention, a plate-shaped toner scraping member extends into the opening portion of the bottle body and has elasticity, and the toner scraping member is provided on the back surface of the cap in the diameter direction of the cap. The outer end of the toner scraping member is positioned inside of the bottle body beyond the opening portion even when the cap is in the cap-opened position, and the outer edge of the toner scraping member is contacted with an inner peripheral surface of the opening portion.

With this constitution, the toner scraping member having elasticity is bent and is brought into contact with the inner peripheral surface of the opening portion, when the toner bottle is rotated. Therefore, adhesion of toner to the inner peripheral surface of the opening portion of the toner bottle can be prevented. Moreover, a reduction in the contact pressure of the toner scraping member, deformation of the cap, damages to the chuck, and an increase in the bottle driving load can be prevented.

In a preferred form of the present invention, the toner scraping member is twisted in the reverse direction of the rotational direction of the bottle body.

With this constitution, the toner scraping member is untwisted during rotation of the toner bottle, and it is again twisted when the rotation of the toner bottle is stopped. Therefore, the toner adhering to the inner peripheral surface of the opening portion of the toner bottle can be scraped off.

In another preferred form of the present invention, the width in the diameter direction of the cap of the toner scraping member is formed to be smaller than the radius of the opening portion.

With this constitution, the width in the diameter direction of one toner scraping member having elasticity is formed so as to become smaller than the radius of the opening portion, and the outer edge of the toner scraping member contacts the inner peripheral surface of the opening portion of the toner bottle. Therefore, the passage of toner can be enlarged and thus the condensation of the toner at the opening portion of the toner bottle can be prevented.

In still another preferred form of the present invention, the toner scraping member is formed so that an angle, which is made by a contact portion between the scraping member and the cap and the inner peripheral surface of the opening portion, is an acute angle.

With this constitution, the angle, which is made by the inner peripheral surface of the opening portion and the contact portion between the scraping member and the cap, is set to an acute angle. Therefore, the toner scraping member becomes easily twistable during rotation of the toner bottle, and it is untwisted when the rotation is stopped. Therefore, toner adhering to the inner peripheral surface of the opening portion of the toner bottle can be scraped off.

In a further preferred form of the present invention, the toner scraping member has a thickness of 0.1 mm through 0.5 mm.

With this constitution, when the toner scraping member is made of plastic having the same hardness as polyethylene, elasticity suitable for toner discharge will be obtained if the thickness of the toner scraping member is set to a range of 0.1 mm through 0.5 mm.

In a further preferred form of the present invention, the width in the diameter direction of the cap of the toner scraping member is formed to be smaller than the radius of the opening portion, and the outer edge of the toner scraping member is disposed in a position which contacts or is near the inner peripheral surface of the opening portion.

With this constitution, the width in the diameter direction of one toner scraping member having elasticity is formed so as to become smaller than the radius of the opening portion, and the outer edge of the toner scraping member is disposed in a position which contacts or is near the contacts the inner peripheral surface of the opening portion of the toner bottle.

Therefore, the passage of toner can be enlarged and thus the condensation of the toner at the opening portion of the toner bottle can be prevented.

In a further preferred form of the present invention, the toner scraping member comprises a plurality of toner scraping members, which are equiangularly disposed with respect to the center of the cap.

With this constitution, the toner scraping member is constituted by a plurality of toner scraping members, which are equiangularly disposed with respect to the center of the cap. Therefore, the force exerted on the cap can be equally distributed, and the cap can be prevented from being tilting during rotation of the toner bottle. Thus, the closing operation of the cap can be reliably performed.

In a further preferred form of the present invention, the toner scraping member has at its outer end portion an inclined portion, which is inclined toward the center line of the cap as it goes toward the outer end portion, and the inclined portion is positioned inside of the opening portion.

With this constitution, the toner scraping member has the inclined portion, which is inclined toward the center line of the cap as it goes toward the outer end portion, and the inclined portion is inside of the opening portion. Therefore, there is no possibility that the outer end of the toner scraping member is caught by the opening portion of the toner bottle when the cap is assembled, and the assembling operation of the cap is considerably enhanced.

BRIEF DESCRIPTION OF THE DRAWINGS

FIG. 9 is a sectional view of a cap showing still another embodiment of the toner bottle of the present invention;

FIGS. 10(*a*) and 10(*b*) are sectional and front views of a cap, respectively, showing still another embodiment of the toner bottle of the present invention; and FIGS. 11(*a*) and 11(*b*) are sectional and front views of a cap, respectively, showing still another embodiment of the present invention.

DETAILED DESCRIPTION OF THE PREFERRED EMBODIMENTS

A preferred embodiment of the present invention will hereinafter be described in detail in accordance with the accompanying drawings.

Figure 1A:
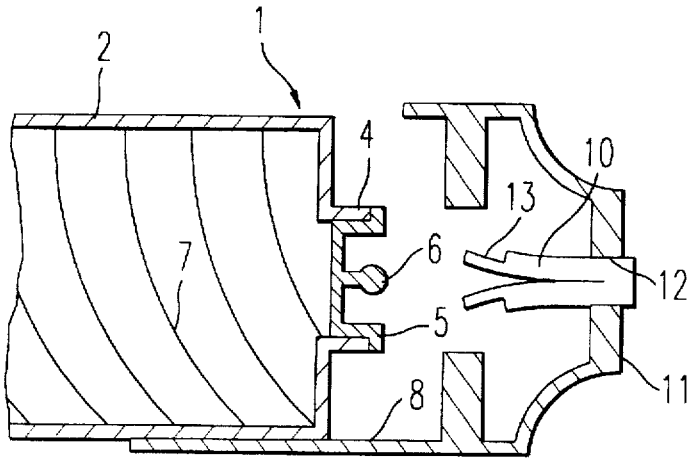
FIG. 1A PRIOR ART
FIGS. 1(*a*), 1(*b*), and 1(*c*) are schematic diagrams showing a conventional mechanism of removing a cap from a toner bottle and the operation.
Figure 1B:
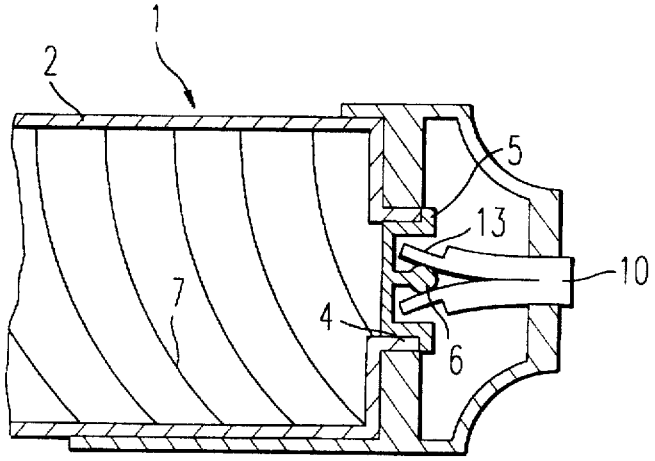
FIG. 1B PRIOR ART
Figure 1C:
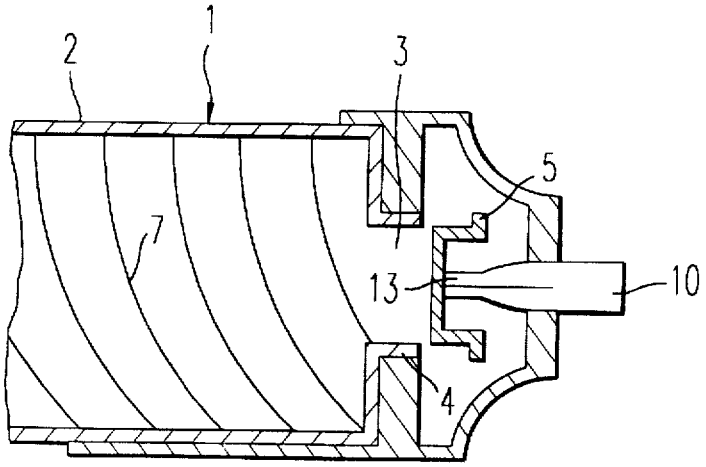
FIG. 1C PRIOR ART
Figure 2:
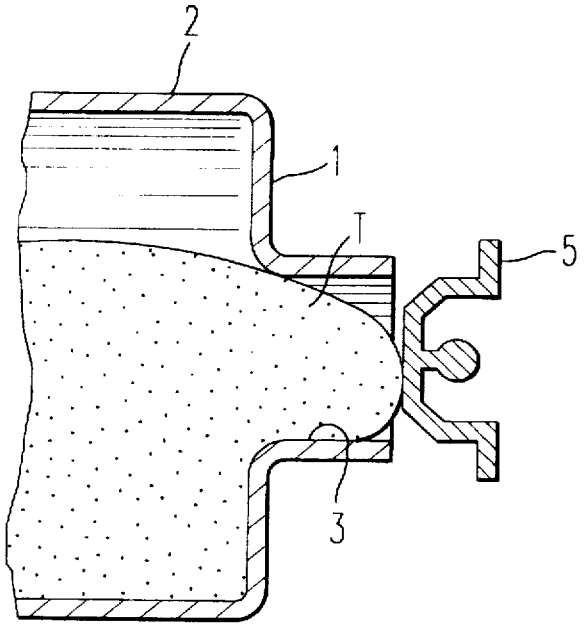
FIG. 2 PRIOR ART
FIG. 2 is a diagram showing a disadvantage of a conventional toner bottle.
Figure 3A:
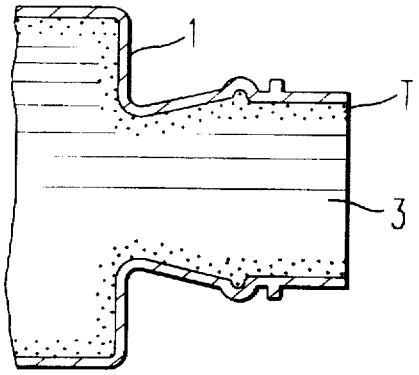
FIG. 3A PRIOR ART
FIGS. 3(*a*) and 3(*b*) are sectional views showing a disadvantage of the conventional toner bottle.
Figure 3B:
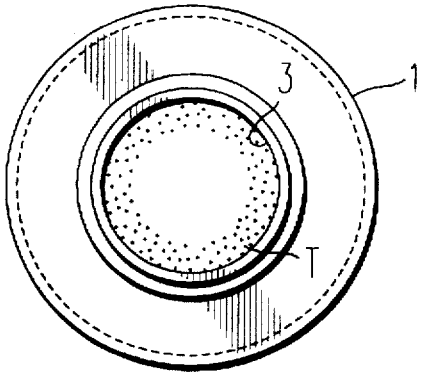
FIG. 3B PRIOR ART
Figure 4:
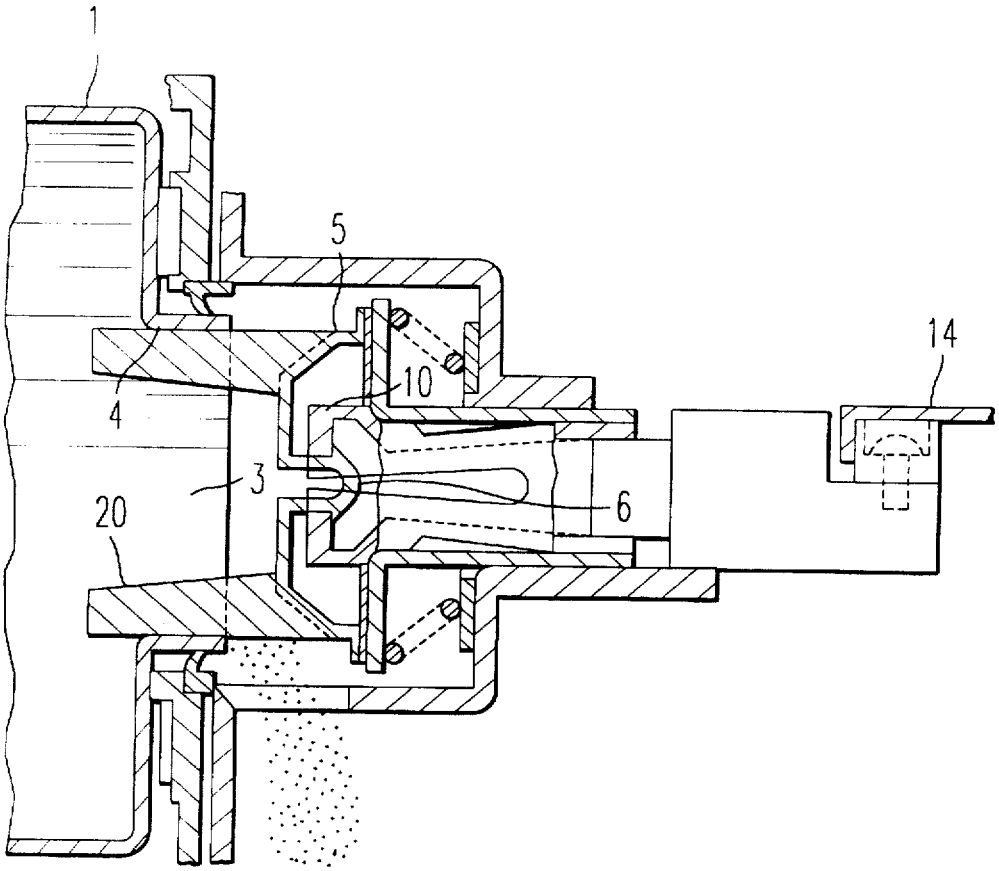
FIG. 4 is a sectional view showing the state when the cap of a toner bottle of the present invention has been removed by a cap removing mechanism.

FIG. 4 is a sectional view showing the state when a cap has been removed by a cap removing mechanism used in a toner bottle, constructed according to the present invention. Note that the same reference numerals will be applied to the same members as FIGS. 1(*a*)–1(*c*)

In FIG. 4, two plate-shaped toner scraping members 20 which extend in the direction going into a bottle body 1 are provided on the back surface (opposite to a tab portion 6) of a cap 5 in the diameter direction of the cap. The cap 5 and the toner scraping members 20 are integrally formed from plastic material such as polyethylene. The toner scraping members 20 have a length which penetrates through an opening portion 3 and a collar 4 extending inwardly from the opening portion 3, even when the cap 5 shown in FIG. 4 is moved and held in the cap-opened state by a cap moving means. Furthermore, the toner scraping members 20 are formed so as to have elasticity. In this case, the toner scraping members 20 can be formed with plastic material having elasticity. However, when the toner scraping members 20 are formed with plastic material having a certain degree of rigidity, elasticity can be given to the toner scraping member 20 by appropriately choosing the thickness. In FIG. 4, reference numeral 14 denotes a plate cam member, which forms part of the aforementioned cap moving means.

In the toner bottle 1 constructed in this way, both the cap fixed and held in the cap-opened state by the cap moving means and the toner bottle 1 are in a relative relationship. Therefore, if the toner bottle 1 is rotated in the cap-opened state, the same effect as the case when the toner scraping members 20 are rotated with respect to the fixed toner bottle 1 will be obtainable. In this case, the toner in the vicinity of the opening portion 3 and the collar 4 is scraped by the toner scraping members 20 and is discharged from the opening portion 3. With the toner scraping operation, the toner blocking at the opening portion 3 and the collar portion 4 can be reliably prevented, and even toner whose fluidity is not good can be used without hindrance. As a consequence, because the kind of toner that can be used is not limited, it becomes possible to adopt a toner supply unit equipped with a cap removing mechanism in a wide variety of image forming apparatuses. In addition, if the toner scraping members 20 have an elastic property, the degree of freedom of the direction where the cap 5 is set will be increased and therefore it will also become possible to set the cap 5 in an oblique direction.

Figure 5:
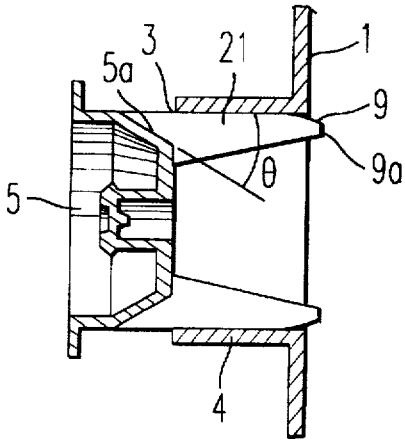
FIG. 5 is a sectional view showing a cap of an embodiment of the present invention.

FIG. 5 is a sectional view of the cap 5 showing an embodiment of the present invention. In this embodiment, two elastic toner scraping members 21 are provided in the cap 5 so that the outer edges contact the inner peripheral surfaces of the opening portion 3 and the collar 4. Each toner scraping member 21 has at its outer end portion an inclined portion 9, which is inclined toward the center line of the cap 5 as it goes toward the outer end portion The outer end 9*a* of the inclined portion 9 is positioned inside of the opening portion 3, as shown in FIG. 5. Furthermore, the toner scraping member 21 is joined to the cap 5 at a contact portion 5*a*, and the angle θ, which is made by the contact portion 5*a* and t hie inner peripheral surfaces of the opening portion 3 and the collar 4, is set so that it becomes an acute angle.

The toner bottle constructed in this way, if rotated after the cap is opened, prevents toner blocking and the toner scraping members 21 slide on and along the inner peripheral surfaces of the opening portion 3 and the collar 4, thereby scraping the toner adhering to the inner peripheral surfaces. Therefore, the reduction in the toner supply quantity, which is caused by the opening area of the opening portion 3 narrowed due to the toner on the inner peripheral surfaces of the opening portion 3 and the collar 4, can be reliably prevented. Incidentally, in the case when the outer edge of the toner scraping member Z1 is slid on and along the inner peripheral surfaces of the opening portion 3 and the collar 4, if the contact pressure is large, the load will be increased during rotation of the toner bottle, and consequently, the fear that the cap 5 will become deformed or the chuck will be damaged will exist. However, because the toner scraping member 21 has elasticity, the contact pressure can be reduced even if it were slid on the inner peripheral surfaces of the opening portion 3 and the collar 4, and there is no fear that the aforementioned problem will occur. Incidentally, when the toner scraping member 21 is made of polyethylene, elasticity suitable for toner discharge will be obtained if the thickness is set in a range of 0.1 mm through 0.5 mm. Particularly, when the thickness is set to 0.3 mm, most suitable flexibility is obtained. If, on the other hand, the thickness of the toner scraping member 21 is set to less than 0.1 mm, it will be excessively bent and toner will become difficult to scrape. In addition, the formation of the toner scraping member itself will become difficult. Furthermore, if the thickness of the scraping member 21 is increased to more than 0.5 mm, the bending will become small, and the cap 5 will become difficult to set unless the corner of the outer edge of the member 21 is chamfered.

In addition, because the toner scraping portion 21 has the inclined portion 9, there is no possibility that the outer end 9*a* of the toner scraping member 21 is caught by the opening portion 3 when the cap 5 is set, and even if the center line of the opening portion 3 and the center line of the cap 5 were offset when setting, the offset would be corrected and therefore the setting operation of the cap 5 would be considerably enhanced.

Furthermore, the angle θ, which is made by the contact portion 5*a* between the toner scraping member 21 and the cap 5 and the inner peripheral surfaces of the opening portion 3 and collar 4, is set to an acute angle, so the toner scraping member 21 will become easily twistable during rotation of the bottle. However, because the toner scraping member 21 is untwisted when the rotation of the bottle is stopped, the toner adhering to the inner peripheral surfaces of the opening portion 3 and the collar 4 can be scraped off. Furthermore, even when the toner scraping member 21 is in the twisted state, the axial length can be kept so that it can contact over the axial length of the inner peripheral sur Laces of the opening portion 3 and the collar 4. Notice that, if the aforementioned angle θ is a right angle, there are some cases where the toner scraping member 21 will slide on the opening portion 3 at the root portion of the member 21 or slide on the collar 4 at the outer end portion, and the longitudinal intermediate portion of the member 21 will not contact these portions 3 and 4 and gap will be formed.

Figure 6A:
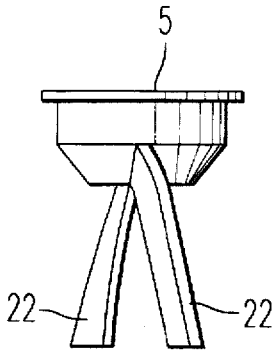
FIGS. 6(*a*), 6(*b*), and 6(*c*) are front, plan, and side views of a cap, respectively, showing another embodiment of the present invention.
Figure 6B:
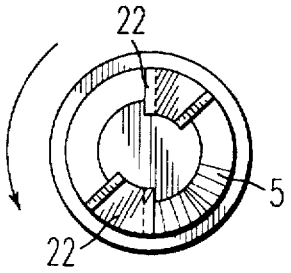
Figure 6C:
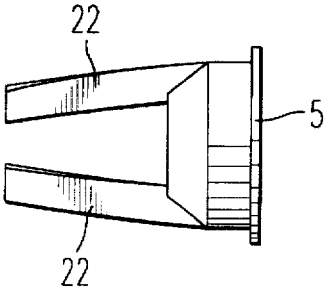

FIGS. 6(*a*), 6(*b*), and 6(*c*) show a front view, a plan views, and a side view of a cap 5, respectively, showing another embodiment of the present invention. In this embodiment, a plate-shaped toner scraping member 22 is twisted in the reverse direction of the rotational direction of the toner bottle 1 with respect to the rotational axis of the toner bottle 1. The toner scraping member 22 can be disposed so as not to contact the opening portion 3 and the collar portion 4 but, in this embodiment, it is in a sliding contact with the inner peripheral surfaces of these portions 3 and 4. Also, the toner scraping member 22 in this embodiment is formed so as to have elasticity.

Figure 7:
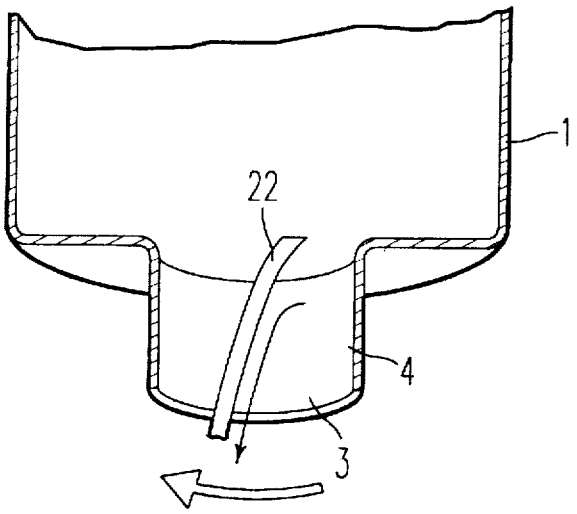
FIG. 7 is a diagram used for explaining the flow of toner when the toner bottle of FIG. 6 is used.

In the toner bottle 1 constructed in this way, if it is rotated after the cap 5 is opened, the toner scraping member 22 slides on the opening portion 3 and the collar 4 and reliably prevents toner condensation. In addition, because the toner scraping member 22 is twisted, the toner on the opening portion 3 and the collar 4 where it tends to stagnate is scraped outside, and a succulent supply quantity is obtained, as shown in FIG. 7. Moreover, the toner scraping member 22 has elasticity. Therefore, if the toner bottle 1 rotates, the shape of the toner scraping member 22 will change in the direction where the twisting is removed, and toner will be discharged. If the rotation of the toner bottle 1 is stopped, the toner scraping member 22 will be twisted again and the toner on the inner peripheral surfaces of the opening portion 3 and the collar 4 can be scraped off.

Different variations of the toner scraping member will now be described in sequence.

Figure 8A:
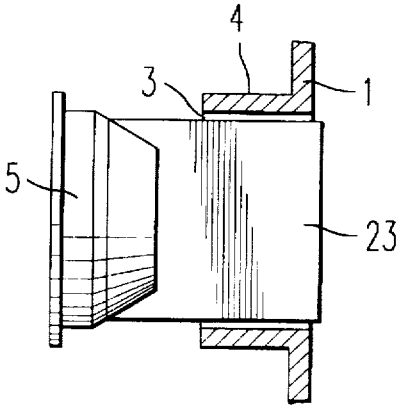
FIGS. 8(*a*) and 8(*b*) are sectional and perspective views of a cap, respectively, showing still another embodiment of the toner bottle of the present invention.
Figure 8B:
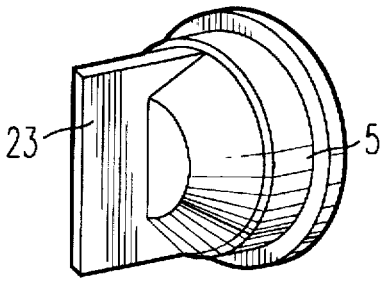

A toner scraping member 23 shown in FIGS. 8(*a*) and 8(*b*) consists of a sheet of plate along approximately the diameter of the cap 5, and the opposite edges of the toner scraping member 23 do not contact the inner peripheral surfaces of the opening portion 3 and the collar 4 but extend up to a position near the inner peripheral surfaces.

The toner scraping member 23 can prevent toner blocking with rotation of the toner bottle 1. Notice that it is arbitrary whether the toner scraping member 23 has elasticity.

Toner scraping members 24 shown in FIG. 9 are substantially identical with the toner scraping member 23 of FIGS. 8(*a*) and 8(*b*) except that the central portion of the toner scraping member 23 is cut out. The radial width in the diameter direction of the cap 5 of each toner scraping member 24 is smaller than the diameter of the opening portion 3.

The toner scraping members 24 can prevent toner blocking, and can enlarge the passage of toner at the opening portion 3 and the collar 4, as compared with the aforementioned toner scraping member 23. As shown in FIG. 9, two upper and lower toner scraping members 24 are provided, but the toner scraping member may consist of one toner scraping member, as shown in FIGS. 10(*a*) and 10(*b*) In In addition, as shown in FIGS. 11(*a*) and 11(*b*), the toner scraping member may be divided into a plurality of toner scraping members 25. In such a case, the toner scraping members 25 are equiangularly disposed with respect to the center line of the cap 5.

If constructed in the aforementioned way, the force exerted on the cap 5 can be equally distributed even when the outer edges of a plurality of toner scraping members 25 are contacted with the inner peripheral surfaces of the opening portion 3 and the collar 4. Therefore, the cap 5 is prevented from being tilting during rotation of the toner bottle 1. Furthermore, because the tilt of the cap 5 can also be prevented when assembling, the assembling operation can be facilitated.

While the present invention has been fully described by way of the preferred embodiments thereof, the invention is not to be limited to the details given herein, but various changes and modifications thereof are possible. For example, although it has been described in the aforementioned embodiments that the cap is removed and held in cap-opened position by clamping the cap by the chuck, the cap may be screwed into the bottle body and it may be moved to and held in the cap-opened position by rotating the cap. Also, in the case where the toner scraping member is contacted with the inner peripheral surfaces of the opening portion and the collar, a sliding member, such as a brush, may be attached to the inner peripheral side of the toner scraping member, and the toner scraping member may be contacted with the inner peripheral surfaces of the opening portion and the collar through the sliding member.

What is claimed is:

1. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending into said opening portion of said bottle body, said toner scraping member being flexible in a circumferential direction of said bottle body said toner scraping member being provided on a back surface of said cap, an outer end of said toner scraping member being positioned inside of said bottle body beyond said opening portion even when said cap is in said cap-opened position.

2. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending into said opening portion of said bottle body, said toner scraping member being provided on a back surface of said cap, an outer end of said toner scraping member being positioned inside of said bottle body beyond said opening portion even when said cap is in said cap-opened position, an outer edge of said toner scraping member being in contact with an inner peripheral surface of said opening portion.

3. The toner bottle as set forth in claim 1 or 2, wherein a width of said toner scraping member in the diameter direction of said cap is formed to be smaller than a radius of said opening portion.

4. The toner bottle as set forth in claim 1 or 2, wherein said toner scraping member comprises a plurality of toner scraping members, said plurality of toner scraping members being spaced out evenly on a periphery of said cap.

5. The toner bottle as set forth in claim 1 or 2, wherein said toner scraping member has an inclined portion at an outer end portion of said toner scraping member, said inclined portion being inclined toward a center line of said cap and being positioned inside of said opening portion.

6. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending into said opening portion of said bottle body, said toner scraping member being flexible in a circumferential direction of said bottle body, said toner scraping member being provided on a back surface of said cap, an outer end of said toner scraping member being positioned inside of said bottle body beyond said opening portion even when said cap is in said cap-opened position, an outer edge of said toner scraping member being in contact with an inner peripheral surface of said opening portion.

7. The toner bottle as set forth in claim 6, wherein said toner scraping member is twisted in a direction opposite to a direction in which said bottle body is rotated.

8. The toner bottle as set forth in claim 6, wherein a width of said toner scraping member in the diameter direction of said cap is formed to be smaller than a radius of said opening portion.

9. The toner bottle as set forth in claim 6, wherein said toner scraping member is formed so that an angle which is made by the inner peripheral surface of said opening portion and a contact portion between said scraping member and said cap is an acute angle.

10. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending into said opening portion of said bottle body, said toner scraping member being flexible in a direction corresponding to a rotation direction of said bottle body said toner scraping member being provided on a back surface of said cap, an outer end of said toner scraping member being positioned inside of said bottle body beyond said opening portion even when said cap is in said cap-opened position, and said toner scraping member having a thickness of 0.1 mm through 0.5 mm.

11. The toner bottle as set forth in claim 10, wherein said toner scraping member is twisted in a direction opposite to a direction in which said bottle body is rotated.

12. The toner bottle as set forth in claim 10, wherein a width of said toner scraping member in the diameter direction of said cap is formed to be smaller than a radius of said opening portion.

13. The toner bottle as set forth in claim 10, wherein said toner scraping member is formed so that an angle which is made by the inner peripheral surface of said opening portion and a contact portion between said scraping member and said cap is an acute angle.

14. The toner bottle as set forth in claim 10, wherein said toner scraping member comprises a plurality of toner scraping members said plurality of toner scraping members being spaced out evenly on a periphery of said cap.

15. The toner bottle as set forth in claim 10, wherein said toner scraping member has an inclined portion at an outer end portion of said toner scraping member, said inclined portion being inclined toward a center line of said cap and being positioned inside of said opening portion.

16. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending in to said opening portion of said bottle body, said toner scraping member being provided on a back surface of said cap, an outer end of said toner scraping member being positioned inside of said bottle body beyond said opening portion even when said cap is in said cap-opened position, an outer edge of said toner scraping member being in contact with an inner peripheral surface of said opening portion, and said toner scraping member having a thickness of 0.1 mm through 0.5 mm.

17. The toner bottle as set forth in claim 16, wherein said toner scraping member is twisted in a direction opposite to a direction in which said bottle body is rotated.

18. The toner bottle as set forth in claim 16, wherein a width of said toner scraping member in the diameter direction of said cap is formed to be smaller than a radius of said opening portion.

19. The toner bottle as set forth in claim 16, wherein said toner scraping member is formed so that an angle which is made by the inner peripheral surface of said opening portion and a contact portion between said scraping member and said cap is an acute angle.

20. The toner bottle as set forth in claim 16, wherein said toner scraping member comprises a plurality of toner scraping members, said plurality of toner scraping members being spaced out evenly on a periphery of said cap.

21. The toner bottle as set forth in claim 16, wherein said toner scraping member has an inclined portion at an outer end portion of said toner scraping member, said inclined portion being inclined toward a center line of said cap and being positioned inside of said opening portion.

22. A toner bottle comprising:

a bottle body for containing toner and giving a feed operation to said toner in one direction by a rotation operation;

a cap for closing an opening portion formed in said bottle body, said toner being supplied in a state in which said cap is held in a cap-opened position where said cap opens said opening portion; and a toner scraping member extending into said opening portion of said bottle body, said toner scraping member being flexible in a direction corresponding to a rotation direction of said bottle body said toner scraping member being provided on a back surface of said cap, an outer end of said toner scraping member being positioned inside of said bottle body beyond said opening portion even when said cap is in said cap-opened position, an outer edge of said toner scraping member being in contact with an inner peripheral surface of said opening portion, and said toner scraping member having a thickness of 0.1 mm through 0.5 mm.

23. The toner bottle as set forth in claim 22, wherein said toner scraping member is twisted in a direction opposite to a direction in which said bottle is rotated.

24. The toner bottle as set forth in claim 22, wherein a width of said toner scraping member in the diameter direction of said cap is formed to be smaller than a radius of said opening portion.

25. The toner bottle as set forth in claim 22, wherein said toner scraping member is formed so that an angle which is made by the inner peripheral surface of said opening portion and a contact portion between said scraping member and said cap is an acute angle.

26. The toner bottle as set forth in claim 22, wherein said toner scraping member comprises a plurality of toner scraping members, said plurality of toner scraping members being spaced out evenly on a periphery of said cap.

27. The toner bottle as set forth in claim 22, wherein said toner scraping member has an inclined portion at an outer end portion of said toner scraping member, said inclined portion being inclined toward a center line of said cap and being positioned inside of said opening portion.

* * * * *